US012152328B2

(12) United States Patent
Song et al.

(10) Patent No.: US 12,152,328 B2
(45) Date of Patent: Nov. 26, 2024

(54) TENTER SYSTEM HAVING FUNCTION OF AUTOMATICALLY CORRECTING FABRIC ON BASIS OF IMAGE

(71) Applicant: Soo Bok Song, Busan (KR)

(72) Inventors: Soo Bok Song, Busan (KR); Won Seok Song, Busan (KR); Ji Hyun Song, Busan (KR); Do Hyeung Kim, Busan (KR)

(73) Assignee: Soo Bok Song, Busan (KR)

( * ) Notice: Subject to any disclaimer, the term of this patent is extended or adjusted under 35 U.S.C. 154(b) by 0 days.

(21) Appl. No.: 18/286,887

(22) PCT Filed: May 27, 2022

(86) PCT No.: PCT/KR2022/007556
§ 371 (c)(1),
(2) Date: Oct. 13, 2023

(87) PCT Pub. No.: WO2023/003161
PCT Pub. Date: Jan. 26, 2023

(65) Prior Publication Data

US 2024/0191415 A1 Jun. 13, 2024

(30) Foreign Application Priority Data

Jul. 19, 2021 (KR) ..... 10-2021-0094317

(51) Int. Cl.
*D06C 3/02* (2006.01)
*D06C 23/00* (2006.01)
*D06H 3/08* (2006.01)

(52) U.S. Cl.
CPC ..... *D06C 3/02* (2013.01); *D06C 23/00* (2013.01); *D06H 3/08* (2013.01); *D06C 2700/02* (2013.01)

(58) Field of Classification Search
CPC ..... D06C 3/026; D06C 3/025; D06C 3/028; D06C 3/00; D06C 3/02; D06C 3/08;
(Continued)

(56) References Cited

U.S. PATENT DOCUMENTS 2,219,213 A * 10/1940 Swain ..... D06H 3/12 34/560
2,311,406 A * 2/1943 Janssen ..... D06H 3/12 26/52

(Continued)

FOREIGN PATENT DOCUMENTS

CN 211171259 U 8/2020
KR 20-1995-0033273 U 12/1995

(Continued)

OTHER PUBLICATIONS

International Search Report from corresponding PCT Application No. PCT/KR2022/007556, dated Dec. 9, 2022.

*Primary Examiner* — Amy Vanatta
(74) *Attorney, Agent, or Firm* — Harness, Dickey & Pierce, P.L.C.

(57) ABSTRACT

The present invention relates to a tenter system having a function of automatically correcting a fabric on the basis of an image, and a method therefor, and the tenter system includes a tenter machine, an introduced-fabric design pattern correction unit provided behind the tenter machine and configured to correct the introduced-fabric design pattern of an input fabric introduced into the tenter machine, a first scanning unit provided in front of the tenter machine and configured to scan the design pattern of a discharged fabric discharged from the tenter machine to acquire a discharged-fabric design pattern image, and a central processing unit configured to communicate with the introduced-fabric design pattern correction unit and the first scanning unit.

7 Claims, 5 Drawing Sheets

(58) Field of Classification Search
CPC ..... D06C 2700/02; D06C 2700/04; D06C 2700/05; D06C 2700/31; D06C 23/00; D06H 3/08; D06H 3/12; D06H 3/125; D06H 2201/10
USPC ..... 26/51.4, 51.5, 91, 70
See application file for complete search history.

(56) References Cited

U.S. PATENT DOCUMENTS 2,355,465 A * 8/1944 Oberkirk ..... D06H 3/125 356/429
2,587,224 A * 2/1952 Robertson ..... D06H 3/12 250/548
2,737,700 A * 3/1956 Thompson ..... D06H 7/08 26/1
2,795,029 A * 6/1957 Broomfield ..... D06H 3/12 73/159
2,966,593 A * 12/1960 Leimer ..... G01N 21/8983 250/548
3,146,511 A * 9/1964 Hoffman ..... D06H 3/12 26/51.4
3,721,809 A * 3/1973 Strandberg, Jr ..... G06M 1/10 242/534
4,017,722 A * 4/1977 Swanson ..... D06C 3/026 700/130
4,656,360 A * 4/1987 Maddox ..... D06H 3/125 250/559.37
4,953,400 A * 9/1990 Bossuyt ..... D04B 35/10 356/238.1
5,035,030 A * 7/1991 Pellari ..... D06C 3/06 26/51.5
6,038,750 A * 3/2000 Pabst ..... D06C 3/026 26/91

FOREIGN PATENT DOCUMENTS

KR 10-0234593 B1 12/1999
KR 10-2009-0046242 A 5/2009
KR 10-0920488 B1 10/2009
KR 10-0933976 B1 12/2009
KR 10-1046217 B1 7/2011
KR 10-1336103 B1 12/2013
KR 10-2270814 B1 6/2021
WO WO-2021170518 A1 * 9/2021

* cited by examiner

TENTER SYSTEM HAVING FUNCTION OF AUTOMATICALLY CORRECTING FABRIC ON BASIS OF IMAGE

CROSS-REFERENCE TO RELATED APPLICATIONS

This application is a national phase application of PCT Application No. PCT/KR2022/007556, filed on 27 May 2022, which claims benefit of Korean Patent Application No. 10-2021-0094317, filed on 19 Jul. 2021. The entire disclosures of the applications identified in this paragraph are incorporated herein by references.

BACKGROUND

Field

The present disclosure relates to a tenter system having a function of automatically correcting a fabric on the basis of an image.

Related Art

In general, a value of a fabric as a product suitable for an intended use cannot be secured just by de-sizing, scouring, bleaching, or dying the fabric. In other words, in a state where processing has not yet been completed, the fabric has a rough feel and is not suitable for use as the fabric, and thus, the fabric is nothing more than a semi-finished product. Accordingly, the original purpose of tentering processes is to increase product value by making excellent products through a tenter processing process appropriate for various fabrics.

In this way, a tenter machine, which is introduced in the process that occupies the most important part in dyeing of various fabrics, supplies hot air at a temperature set according to a type of the fabric to the fabric being transferred, thereby correcting a density for a certain width or length of the fabric and providing pre-setting, water repellent, flexible processing, pre-shrinking, anti-fouling effects, or the like.

Accordingly, by performing various finishing processes that appropriately apply properties of fibers that make up various fabrics for each purpose, it is possible to fully demonstrate characteristics of the fabric, and modify performance of the fabric by supplementing shortcomings of the fabric to beautify the fabric.

FIG. 1 is a diagram illustrating the structure of a typical tentering process. As illustrated in FIG. 1, a chemical tank 2 and a tenter machine 10 are installed along the transfer path of a supplied fabric 1. The chemical tank 2 contains chemicals such as dyes and softeners inside the chemical tank, and a plurality of rollers are installed on an upper portion and an inner side of an inlet side of the chemical tank 2 to guide the fabric 1 in a state where the fabric is immersed in the chemicals and then transported. A mangle 3 including a pair of rollers is installed on the upper portion of a discharge side of the chemical tank 2 to spread the fabric 1 and primarily remove foreign substances and chemicals on the fabric 1. The tenter machine (10) includes a plurality of drying chambers 10*a* and 10*b* through which the fabric 1 passes inside the tenter machine, a hot air supplier 11*a* is provided in each of the drying chambers 10*a* and 10*b* to spray high-temperature air toward the fabric 1, and thus, chemicals and water remaining on the fabric 1 after passing through the mangle 3 are removed by heat.

In the tentering process, a design pattern of the fabric finally obtained by introducing the fabric having a certain design pattern into the tenter machine, subjecting the fabric to the tentering process, and cooling the fabric is shrunk or twisted in a lateral direction and/or a longitudinal direction compared to a design pattern of the initially introduced fabric, and thus, deformation may occur. For example, a lateral spacing of the design pattern may be narrow as the fabric subjected to the tentering process is shrunk in the lateral direction, a longitudinal spacing of the design pattern may be narrow as the fabric subjected to the tentering process is shrunk in the longitudinal direction, or left and right deformation of the design pattern may occur.

When the deformation occurs, in the conventional tentering process, a worker can prevent and correct the deformation of the fabric design pattern by introducing the fabric to the tenter machine while manually correcting the lateral spacing and/or longitudinal spacing of the introduced fabric.

However, in the continuously performed tentering process, the worker manually corrects the lateral spacing and/or the longitudinal spacing of the introduced fabric by inspecting the design pattern of the fabric that is subjected to the tentering process and then finally obtained through cooling and checking for deformation of the design pattern to correct the deformation. Accordingly, not only is the correction of the design pattern not precise, but work efficiency is also significantly reduced.

PATENT LITERATURE (Patent Document 1) Korea Patent No. 10-1046217 (Jun. 28, 2011)

(Patent Document 2) Korea Patent No. 10-0920488 (Sep. 29, 2009)

(Patent Document 3) Korea Patent No. 10-0234593 (Sep. 17, 1999)

SUMMARY

An object of the present disclosure is to provide a tenter system having a function of automatically correcting a fabric on the basis of an image capable of automatically correcting a pattern of an introduced fabric in one aspect.

Another object of the present disclosure is to provide a method of automatically correcting a fabric by a tenter system on the basis of an image capable of automatically correcting a pattern of an introduced fabric in another aspect.

According to an aspect of the present disclosure, there is provided a tenter system having a function of automatically correcting a fabric on the basis of an image, the tenter system including: a tenter machine; an introduced-fabric design pattern correction unit provided behind the tenter machine and configured to correct an introduced-fabric design pattern of an input fabric introduced into the tenter machine; a first scanning unit provided in front of the tenter machine and configured to scan a design pattern of a discharged fabric discharged from the tenter machine to acquire a discharged-fabric design pattern image; and a central processing unit configured to communicate with the introduced-fabric design pattern correction unit and the first scanning unit, in which when a standard design pattern image is input from a user, the discharged-fabric design pattern image is provided by the first scanning unit, the standard design pattern image and the discharged-fabric design pattern image are compared with each other, and a comparison result exceeds a predetermined setting range, the central processing unit controls the introduced-fabric design pattern correction unit to correct the introduced-fabric design pattern by adjusting at least one of a lateral width and supply speed of the introduced fabric.

According to another aspect of the present disclosure, there is provided a method of automatically correcting a fabric by a tenter system on the basis of an image, the method including: a standard design pattern image input step of inputting a standard design pattern image; a discharged-fabric design pattern image acquisition step of acquiring a discharged-fabric design pattern image of a discharged fabric discharged from a tenter machine; a discharged fabric design pattern deformation determination step of comparing the input standard design pattern image with the obtained discharged-fabric design pattern image and determining as discharged fabric design pattern deformation when a comparison result exceeds a predetermined setting range; and an introduced-fabric design pattern correction step of correcting the introduced-fabric design pattern by adjusting at least one of a lateral width and a supply speed of the introduced fabric introduced to the tenter machine according to the determination of deformation of the discharged fabric design pattern.

A tenter system according to one aspect of the present disclosure can provide an image-based automatic fabric correction function capable of automatically correcting the design pattern of the fabric.

The tenter system fabric automatic correction method according to another aspect of the present disclosure can provide an image-based tenter system fabric automatic correction function that can automatically correct the design pattern of the fabric.

DESCRIPTION OF EXEMPLARY EMBODIMENTS

Hereinafter, various specific examples of the present disclosure will be described in detail with reference to the attached drawings.

Figure 1:
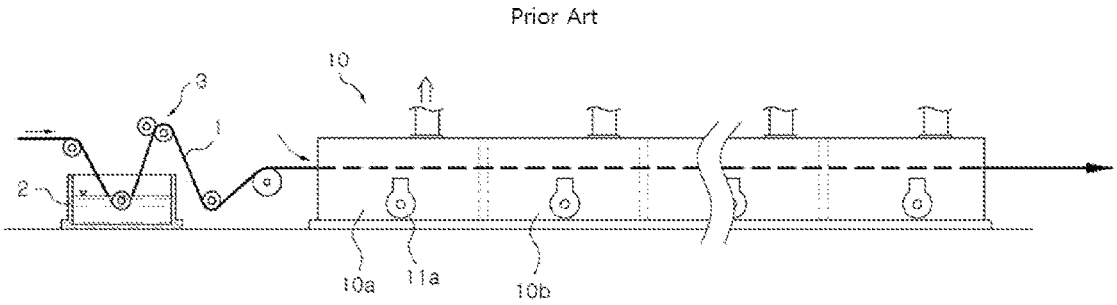
FIG. 1 is a diagram illustrating a structure of a typical tentering process.
Figure 2:
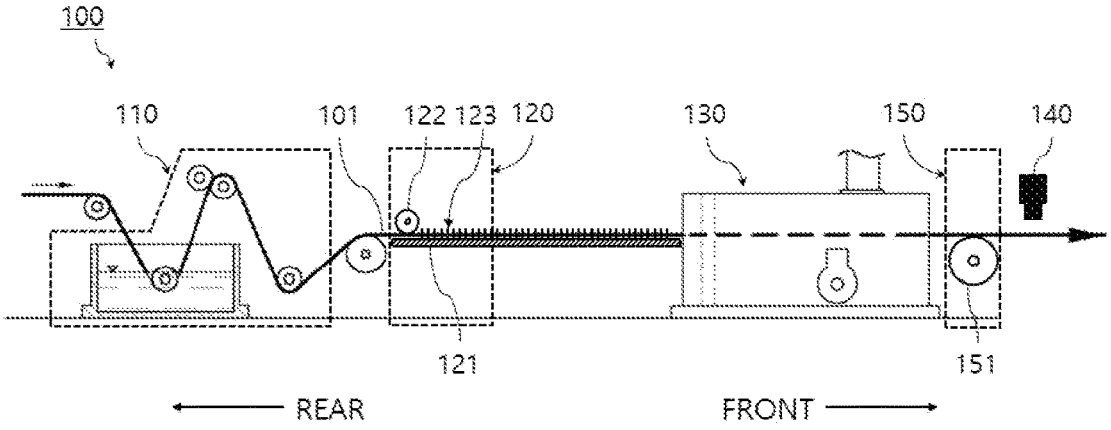
FIG. 2 is an installation diagram illustrating a tenter system according to one aspect of the present disclosure.
Figure 3:
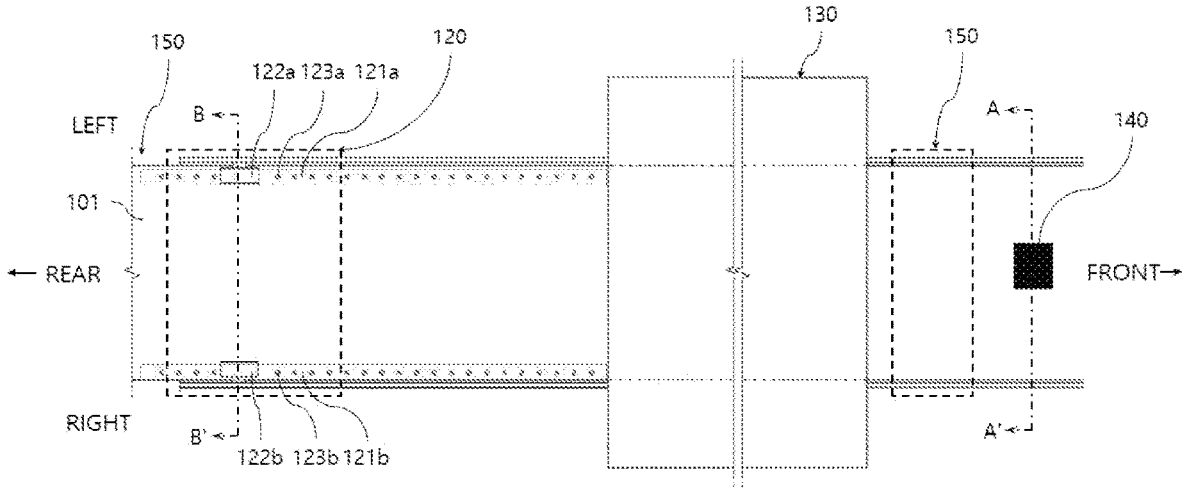
FIG. 3 is a plan view of the tenter system according to one aspect of the present disclosure.
Figure 4:
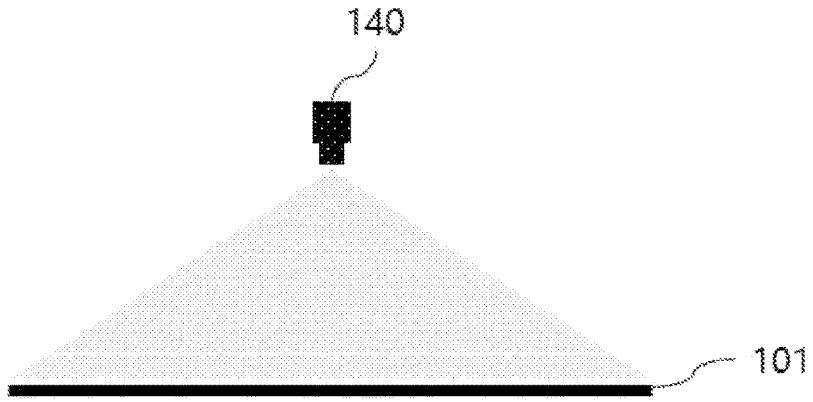
FIG. 4 is a cross-sectional view taken along the line A-A' of FIG. 3.
Figure 5:
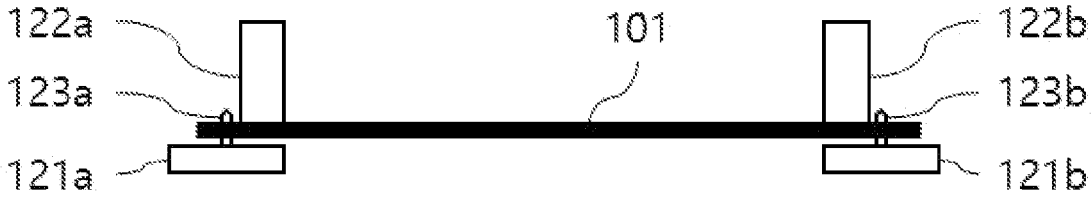
FIG. 5 is a cross-sectional view taken along line B-B' of FIG. 3.

FIG. 2 is an installation diagram illustrating a tenter system according to one aspect of the present disclosure, FIG. 3 is a plan view of the tenter system according to one aspect of the present disclosure, FIG. 4 is a cross-sectional view taken along the line A-A' of FIG. 3, and FIG. 5 is a cross-sectional view taken along line B-B' of FIG. 3.

Referring to FIGS. 2 to 5, a tenter system 100 according to one embodiment of one aspect of the present disclosure includes a tenter machine 130, an introduced-fabric design pattern correction unit 120, a first scanning unit 140, and a central processing unit (not illustrated). Meanwhile, the tenter system 100 further includes a fabric supply unit 110.

Unless otherwise stated in the present disclosure, the fabric supply unit 110 and the tenter machine 130 are well known.

Also, unless otherwise stated in the present disclosure, a front refers to the front of the direction in which a fabric 101 moves, and a rear refers to the rear of the direction in which the fabric 101 moves.

In the tenter system 100 of the present disclosure, after the fabric 101 is supplied to the tenter system 100 through the fabric supply unit 110, the fabric sequentially passes through the introduced-fabric design pattern correction unit 120, the tenter machine 130, and the first scanning unit 140 and is finally discharged.

The introduced-fabric design pattern correction unit 120 is provided at the rear of the tenter machine 130 and is configured to correct the introduced-fabric design pattern of the introduced fabric introduced to the tenter machine 130.

The first scanning unit 140 is provided in front of the tenter machine 130 and is configured to scan the design pattern of the discharged fabric discharged from the tenter machine 130 to obtain a discharged-fabric design pattern image.

The central processing unit (not illustrated) is configured to communicate with the introduced-fabric design pattern correction unit 120 and the first scanning unit 140.

When the central processing unit (not illustrated) receives a standard design pattern image from a user, receives the discharged-fabric design pattern image from the first scanning unit 140, and compares the standard design pattern image and the discharged-fabric design pattern image with each other, and the comparison result exceeds a predetermined setting range, the central processing unit may control the introduced-fabric design pattern correction unit 120 to correct the introduced-fabric design pattern by adjusting at least one of a lateral width and supply speed of the introduced fabric.

Figure 6:
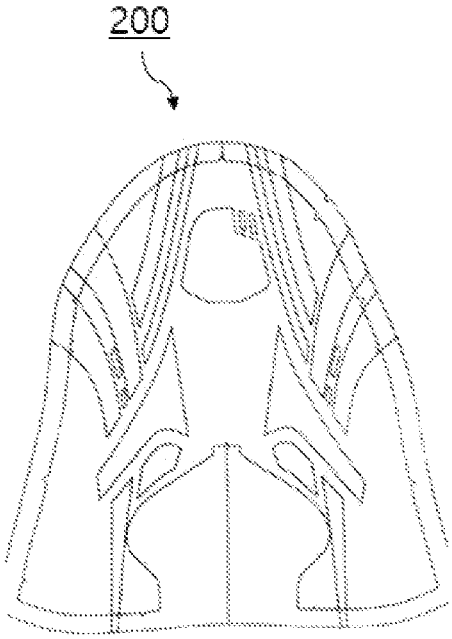
FIG. 6 is a diagram illustrating a standard design pattern according to one embodiment of the present disclosure.
Figure 7:
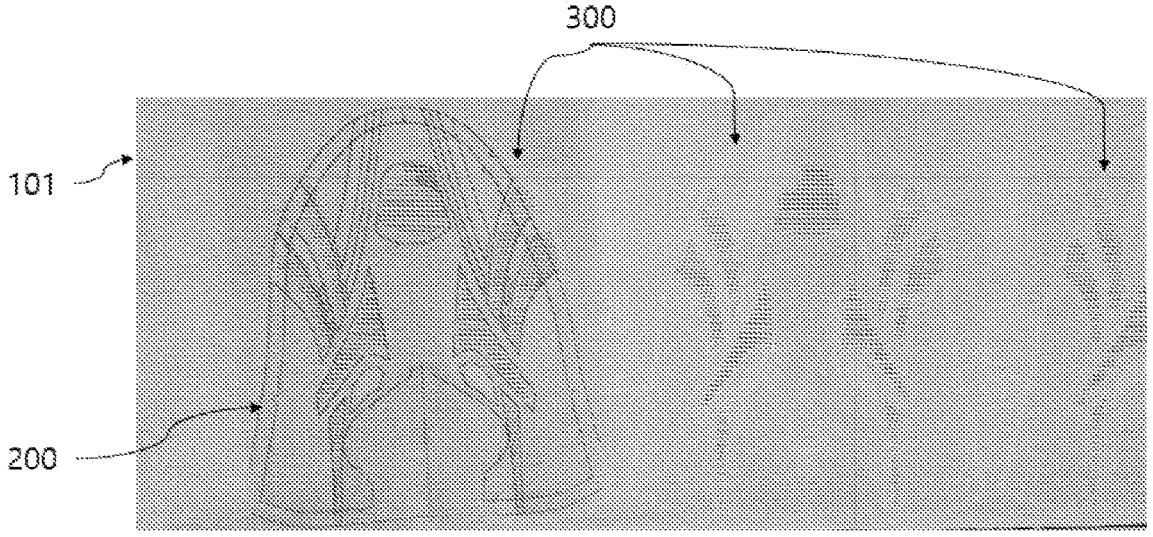
FIG. 7 is a diagram presented by overlapping the standard design pattern and a fabric design pattern formed on a fabric according to one embodiment of the present disclosure.

FIG. 6 is a diagram illustrating a standard design pattern 200 according to one embodiment of the present disclosure, and FIG. 7 is a diagram presented by overlapping the standard design pattern 200 and a fabric design pattern 300 formed on a fabric according to one embodiment of the present disclosure. To describe FIG. 7 in more detail, the fabric design patterns 300 formed on the fabric 101 are presented, and the standard design pattern 200 is placed to overlap the fabric design pattern 300 located on the leftmost side among the fabric design patterns 300.

Referring to FIGS. 6 and 7, the standard design pattern 200 is the original design pattern of the fabric design pattern 300 formed on the fabric 101. That is, when weaving the fabric 101, the fabric design pattern 300 woven by a loom (not illustrated) based on the standard design pattern 200 is formed on the fabric 101.

As will be explained in detail below, when the fabric (that is, introduced fabric) including the fabric design pattern 300 woven based on the standard design pattern 200 undergoes a tentering process and is then cooled, the fabric may be shrunk in a lateral direction and/or longitudinal direction, twisted, and thus, deformed. Therefore, the design pattern of the finally obtained fabric (that is, discharged fabric) may differ significantly from the design pattern of the introduced fabric introduced to the tenter machine in a lateral spacing and/or longitudinal spacing, or deformation may occur in the design pattern of the discharged fabric. The present disclosure is intended to correct for the deformation.

Before performing the tentering process, the user can input the standard design pattern image obtained by photographing the standard design pattern 200 into the central processing unit (not illustrated).

The fabric introduced into the tenter machine 130 may undergo the tentering process while passing through the tenter machine 130 and may then be deformed by shrinking or twisting in the lateral direction and/or longitudinal direction as the fabric is cooled. Therefore, the design pattern of the discharged fabric that is finally obtained may have significant differences in the lateral spacing and/or longitudinal spacing from the design pattern of the introduced fabric introduced to the tenter machine, or the deformation may occur.

Therefore, by detecting the degree to which the fabric shrinks or twists as the fabric goes through the tentering process and then is cooled, determining the degree of deformation of the discharged fabric compared to the introduced fabric, and correcting the lateral spacing, longitudinal spacing, and/or distortion of the design pattern of the introduced fabric, the design pattern of the finally obtained discharged fabric can be matched to the standard design pattern.

The tenter system 100 according to another embodiment of one aspect of the present disclosure further includes a discharged fabric cooling unit 150, and the discharged fabric cooling unit 150 is configured to be disposed between the tenter machine 130 and a first scanning unit 140.

Unless otherwise stated in the present disclosure, the discharged fabric cooling unit 150 is well known.

In another embodiment of one aspect of the present disclosure, the introduced-fabric design pattern correction unit 120 includes a fabric transfer conveyor belt 121.

The fabric transfer conveyor belt 121 includes a first fabric transfer conveyor belt 121*a* and a second fabric transfer conveyor belt 121*b* which are disposed to be spaced apart from each other on the left and right sides of the introduced fabric and are controlled independently.

The first fabric transfer conveyor belt 121*a* is configured to transfer the left edge of the introduced fabric, and the second fabric transfer conveyor belt 121*b* is configured to transfer the right edge of the introduced fabric. The first fabric transfer conveyor belt 121*a* and the second fabric transfer conveyor belt 121*b* each include fabric transfer pins 123*a* and 123*b* formed to protrude upward. More specifically, the first fabric transfer conveyor belt 121*a* is configured so that the left edge of the introduced fabric is fixed to the first fabric transfer pin 123*a* and transferred. Similarly, the second fabric transfer conveyor belt 121*b* is configured so that the right edge of the introduced fabric is fixed to the second fabric transfer pin 123*b* and transferred.

Moreover, the introduced-fabric design pattern correction unit 120 further includes a fabric fixing roller 122 that is in contact with the upper surface of the fabric 101 and rotates in a state of pressing the fabric 101 downward toward the fabric transfer conveyor belt 121. The fabric fixing roller 122 includes a first fabric fixing roller 122*a* and a second fabric fixing roller 122*b* that press the first fabric transfer conveyor belt 121*a* and the second fabric transfer conveyor belt 121*b* downward, respectively.

At least one of the first fabric transfer conveyor belt 121*a* and the second fabric transfer conveyor belt 121*b* is configured to be movable in the lateral direction to adjust the lateral spacing of the introduced-fabric design pattern. More specifically, the left edge of the introduced fabric may be fixed to the first fabric transfer pin 123*a* and transferred, and the right edge of the introduced fabric may be fixed to the second fabric transfer pin 123*b* and transferred. Therefore, in a case where it is necessary to widen the lateral spacing of the introduced-fabric design pattern, when at least one of the first fabric transfer conveyor belt 121*a* and the second fabric transfer conveyor belt 121*b* is moved in the lateral direction to widen the gap between the first fabric transfer conveyor belt 121*a* and the second fabric transfer conveyor belt 121*b*, the introduced fabric is also stretched in the lateral direction, ultimately widening the lateral spacing of the introduced-fabric design pattern.

In another embodiment of one aspect of the present disclosure, at least one of the first fabric transfer conveyor belt 121*a* and the second fabric transfer conveyor belt 121*b* is configured to adjust the longitudinal spacing of the introduced-fabric design pattern and adjust a supply speed of the introduced fabric. More specifically, as described above, the left edge of the introduced fabric may be fixed to the first fabric transfer pin 123*a* and transferred, and the right edge of the introduced fabric may be fixed to the second fabric transfer pin 123*b* and transferred. Therefore, in a case where it is necessary to widen the longitudinal spacing of the introduced-fabric design pattern, by reducing the rotation speed of at least one of the first fabric transfer conveyor belt 121*a* and the second fabric transfer conveyor belt 121*b*, the supply speed of the introduced fabric is reduced, but because the fabric is pulled by the tension of the fabric portion already introduced into the tenter machine 130, the longitudinal spacing of the introduced-fabric design pattern can eventually be widened.

In another embodiment of one aspect of the present disclosure, when the central processing unit (not illustrated) compares the lateral spacing of the standard design pattern image with the lateral spacing of the discharged-fabric design pattern image and the comparison result exceeds a predetermined setting range, the central processing unit controls the introduced-fabric design pattern correction unit 120 to correct the introduced-fabric design pattern by moving at least one of the first fabric transfer conveyor belt 121*a* and the second fabric transfer conveyor belt 121*b* in a lateral direction. As described above, by moving at least one of the first fabric transfer conveyor belt 121*a* and the second fabric transfer conveyor belt 121*b* in the lateral direction to widen the spacing between the first fabric transfer conveyor belt 121*a* and the second fabric transfer conveyor belt 121*b*, the introduced fabric also stretches in lateral direction, ultimately widening the lateral spacing of the introduced-fabric design pattern.

In another embodiment of one aspect of the present disclosure, when the central processing unit (not illustrated) compares the longitudinal spacing of the standard design pattern image with the longitudinal spacing of the discharged-fabric design pattern image and the comparison result exceeds a predetermined setting range, the central processing unit controls the introduced-fabric design pattern correction unit to correct the introduced-fabric design pattern by adjusting the rotation speed of at least one of the first fabric transfer conveyor belt 121*a* and the second fabric transfer conveyor belt 121*b*. As described above, when the rotation speed of at least one of the first fabric transfer conveyor belt 121*a* and the second fabric transfer conveyor belt 121*b* is reduced, the supply speed of the introduced fabric is reduced, but because the fabric is pulled by the tension of the fabric portion already introduced into the tenter machine 130, the longitudinal spacing of the introduced-fabric design pattern can eventually be widened.

In another embodiment of one aspect of the present disclosure, the central processing unit (not illustrated) when the central processing unit compares the standard design pattern image and the discharged-fabric design pattern image and distortion of the discharged-fabric design pattern image occurs, the central processing unit controls the fabric design pattern correction unit to correct the introduced-fabric design pattern by increasing or decreasing any one of the rotation speeds of the first fabric transfer conveyor belt 121*a* and a rotation speed of the second fabric transfer conveyor belt 121*b*. As described above, the left edge of the introduced fabric may be fixed to the first fabric transfer pin 123*a* and transferred, and the right edge of the introduced fabric may be fixed to the second fabric transfer pin 123*b* and transferred. Therefore, when the left portion of the discharged-fabric design pattern image is pushed backward compared to the right portion thereof and the distortion occurs, it is possible to correct the distortion by increasing the rotation speed of the first fabric transfer conveyor belt 121*a* or reducing the rotation speed of the second fabric transfer conveyor belt 121*b*. Meanwhile, when the right portion of the discharged-fabric design pattern image is pushed backward compared to the left portion thereof and the distortion occurs, it is possible to correct the distortion by reducing the rotation speed of the first fabric transfer conveyor belt 121*a* or increasing the rotation speed of the second fabric transfer conveyor belt 121*b*.

In another embodiment of one aspect of the present disclosure, control of the introduced-fabric design pattern correction unit by the central processing unit may be performed by a machine learning method.

Figure 8:
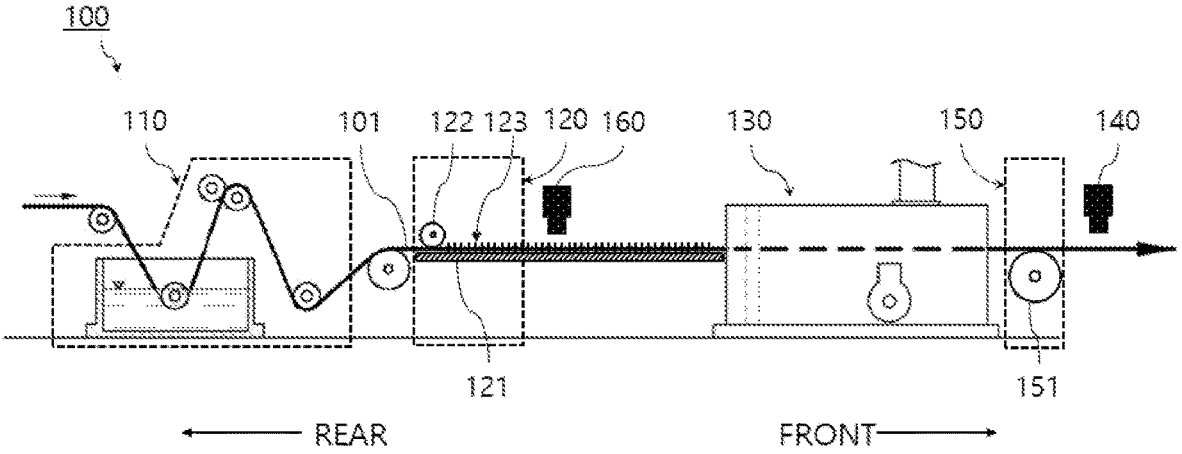
FIG. 8 is an installation diagram illustrating a tenter system according to another aspect of the present disclosure.
Figure 9:
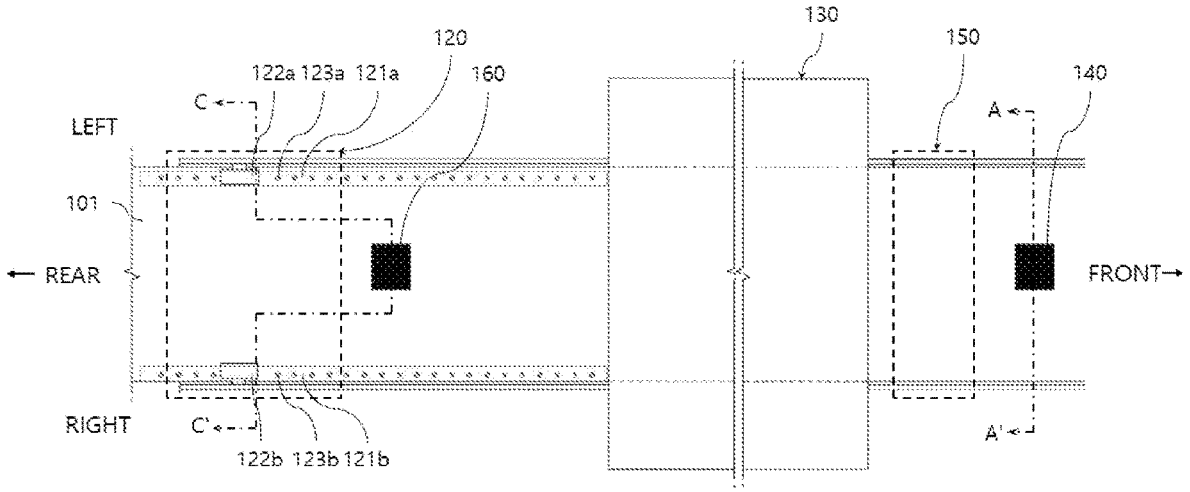
FIG. 9 is a plan view of a tenter system according to another aspect of the present disclosure.
Figure 10:
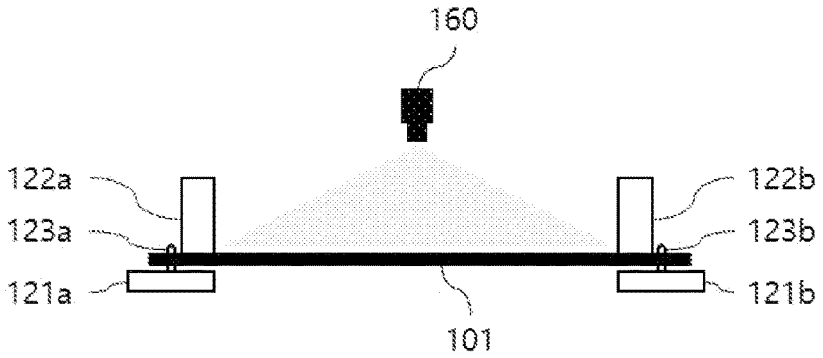
FIG. 10 is a cross-sectional view taken along line C-C' of FIG. 9.

FIG. 8 is an installation diagram illustrating a tenter system according to another aspect of the present disclosure, FIG. 9 is a plan view of the tenter system according to another aspect of the present disclosure, and FIG. 10 is a cross-sectional view taken along line C-C' of FIG. 9.

Referring to FIGS. 8 to 10, in another embodiment of one aspect of the present disclosure, the tenter system of the present disclosure further includes a second scanning unit 160 which is provided between the design pattern correction unit 120 and the tenter machine 130 and is configured to acquire the introduced-fabric design pattern image by scanning the design pattern of the introduced fabric after passing through the design pattern correction unit 120. In this case, the central processing unit is configured to receive the introduced-fabric design pattern image by communicating with the second scanning unit 160. In addition, when the central processing unit compares the standard design pattern image and the introduced-fabric design pattern image and the comparison result exceeds a predetermined setting range, the central processing unit may control the introduced-fabric design pattern correction unit to correct the introduced-fabric design pattern by adjusting at least one of the lateral width and the supply speed of the introduced fabric.

When the central processing unit compares the introduced-fabric design pattern image provided by the second scanning unit 160 with the standard design pattern image and the distortion of the introduced-fabric design pattern image occurs, preferably, the central processing unit may control the fabric design pattern correction unit to correct the introduced-fabric design pattern by increasing or decreasing any one of the rotation speed of the first fabric transfer conveyor belt 121*a* and the rotation speed of the second fabric transfer conveyor belt 121*b*.

In another embodiment of another aspect of the present disclosure, there is provided a method of automatically correcting a fabric by a tenter system on the basis of an image, the method including a standard design pattern image input step of inputting a standard design pattern image, a discharged-fabric design pattern image acquisition step of acquiring a discharged-fabric design pattern image of a discharged fabric discharged from a tenter machine, a discharged fabric design pattern deformation determination step of comparing the input standard design pattern image with the obtained discharged-fabric design pattern image and determining as discharged fabric design pattern deformation when a comparison result exceeds a predetermined setting range, and an introduced-fabric design pattern correction step of correcting the introduced-fabric design pattern by adjusting at least one of a lateral width and a supply speed of the introduced fabric introduced to the tenter machine according to the determination of deformation of the discharged fabric design pattern.

In another embodiment of another aspect of the present disclosure, the discharged fabric design pattern deformation determination step includes a lateral deformation determination step of comparing the lateral spacing of the standard design pattern image and the lateral spacing of the discharged-fabric design pattern image and determining as discharged fabric design pattern lateral deformation when the comparison result exceeds a predetermined setting range, and the introduced-fabric design pattern correction step includes an introduced-fabric design pattern lateral correction step of correcting the introduced-fabric design pattern by adjusting the lateral width of the introduced fabric introduced to the tenter machine according to the discharged fabric design pattern lateral deformation determination.

In another embodiment of another aspect of the present disclosure, the discharged fabric design pattern deformation determination step includes a lateral deformation determination step of comparing the longitudinal spacing of the standard design pattern image with the longitudinal spacing of the discharged-fabric design pattern image and determining as discharged fabric design pattern lateral deformation when the comparison result exceeds a predetermined setting range, and the introduced-fabric design pattern correction step includes an introduced-fabric design pattern lateral correction step of correcting the introduced-fabric design pattern by adjusting the supply speed of the introduced fabric introduced to the tenter machine according to the discharged fabric design pattern lateral deformation determination and adjusting a lateral width.

In another embodiment of another aspect of the present disclosure, the discharged fabric design pattern deformation determination step includes a distortion deformation determination step of comparing the standard design pattern image and the discharged-fabric design pattern image and determining as discharged fabric design distortion pattern deformation when distortion of the discharged-fabric design pattern image occurs, and the introduced-fabric design pattern correction step includes an introduced-fabric design pattern distortion correction step of correcting the introduced-fabric design pattern by increasing or reducing any one of the supply speeds of the left and right edges of the introduced fabric introduced to the tenter machine according to the discharged fabric design pattern distortion deformation determination to adjust the distortion.

The following describes various embodiments of the present disclosure.

(1) A tenter system having a function of automatically correcting a fabric on the basis of an image, the tenter system including: a tenter machine; an introduced-fabric design pattern correction unit provided behind the tenter machine and configured to correct an introduced-fabric design pattern of an input fabric introduced into the tenter machine; a first scanning unit provided in front of the tenter machine and configured to scan a design pattern of a discharged fabric discharged from the tenter machine to acquire a discharged-fabric design pattern image; and a central processing unit configured to communicate with the introduced-fabric design pattern correction unit and the first scanning unit, in which when a standard design pattern image is input from a user, the discharged-fabric design pattern image is provided by the first scanning unit, the standard design pattern image and the discharged-fabric design pattern image are compared with each other, and a comparison result exceeds a predetermined setting range, the central processing unit controls the introduced-fabric design pattern correction unit to correct the introduced-fabric design pattern by adjusting at least one of a lateral width and supply speed of the introduced fabric.

(2) The tenter system further includes a discharged fabric cooling unit, in which the discharged fabric cooling unit is disposed between the tenter machine and the first scanning unit.

(3) In the tenter system, the introduced-fabric design pattern correction unit includes a fabric transfer conveyor belt, the fabric transfer conveyor belt includes a first fabric transfer conveyor belt and a second fabric transfer conveyor belt which are disposed to be spaced apart from each other at left and right sides of the introduced fabric and independently controlled, the first fabric transport conveyor belt transports a left edge of the introduced fabric, the second fabric transport conveyor belt transports a right edge of the introduced fabric, and at least one of the first fabric transport conveyor belt and the second fabric transport conveyor belt is configured to be movable laterally to adjust a lateral spacing of the introduced-fabric design pattern.

(4) In the tenter system of claim 3, at least one of the first fabric transfer conveyor belt and the second fabric transfer conveyor belt is configured to adjust a supply speed of the introduced fabric to adjust a longitudinal spacing of the introduced-fabric design pattern.

(5) In the tenter system, when the central processing unit compares a lateral spacing of the standard design pattern image with a lateral spacing of the discharged-fabric design pattern image and a comparison result exceeds a predetermined setting range, the central processing unit controls the introduced-fabric design pattern correction unit to correct the introduced-fabric design pattern by moving at least one of the first fabric transfer conveyor belt and the second fabric transfer conveyor belt in a lateral direction.

(6) In the tenter system, when the central processing unit compares a longitudinal spacing of the standard design pattern image with a longitudinal spacing of the discharged-fabric design pattern image and a comparison result exceeds a predetermined setting range, the central processing unit controls the introduced-fabric design pattern correction unit to correct the introduced-fabric design pattern by adjusting a rotation speed of at least one of the first fabric transfer conveyor belt and the second fabric transfer conveyor belt.

(7) In the tenter system, when the central processing unit compares the standard design pattern image and the discharged-fabric design pattern image and distortion of the discharged-fabric design pattern image occurs, the central processing unit controls the fabric design pattern correction unit to correct the introduced-fabric design pattern by increasing or decreasing any one of rotation speeds of the first fabric transfer conveyor belt and a rotation speed of the second fabric transfer conveyor belt.

(8) In the tenter system, control of the introduced-fabric design pattern correction unit by the central processing unit is performed by a machine learning method.

(9) A method of automatically correcting a fabric by a tenter system on the basis of an image, the method including: a standard design pattern image input step of inputting a standard design pattern image; a discharged-fabric design pattern image acquisition step of acquiring a discharged-fabric design pattern image of a discharged fabric discharged from a tenter machine; a discharged fabric design pattern deformation determination step of comparing the input standard design pattern image with the obtained discharged-fabric design pattern image and determining as discharged fabric design pattern deformation when a comparison result exceeds a predetermined setting range; and an introduced-fabric design pattern correction step of correcting the introduced-fabric design pattern by adjusting at least one of a lateral width and a supply speed of the introduced fabric introduced to the tenter machine according to the determination of deformation of the discharged fabric design pattern.

(10) In the method, the discharged fabric design pattern deformation determination step includes a lateral deformation determination step of comparing the lateral spacing of the standard design pattern image and the lateral spacing of the discharged-fabric design pattern image and determining as discharged fabric design pattern lateral deformation when the comparison result exceeds a predetermined setting range, and the introduced-fabric design pattern correction step includes an introduced-fabric design pattern lateral correction step of correcting the introduced-fabric design pattern by adjusting the lateral width of the introduced fabric introduced to the tenter machine according to the discharged fabric design pattern lateral deformation determination.

(11) In this method, the discharged fabric design pattern deformation determination step includes a lateral deformation determination step of comparing the longitudinal spacing of the standard design pattern image with the longitudinal spacing of the discharged-fabric design pattern image and determining as discharged fabric design pattern lateral deformation when the comparison result exceeds a predetermined setting range, and the introduced-fabric design pattern correction step includes an introduced-fabric design pattern lateral correction step of correcting the introduced-fabric design pattern by adjusting the supply speed of the introduced fabric introduced to the tenter machine according to the discharged fabric design pattern lateral deformation determination and adjusting a lateral width.

(12) In the method, the discharged fabric design pattern deformation determination step includes a distortion deformation determination step of comparing the standard design pattern image and the discharged-fabric design pattern image and determining as discharged fabric design distortion pattern deformation when distortion of the discharged-fabric design pattern image occurs, and the introduced-fabric design pattern correction step includes an introduced-fabric design pattern distortion correction step of correcting the introduced-fabric design pattern by increasing or reducing any one of the supply speeds of the left and right edges of the introduced fabric introduced to the tenter machine according to the discharged fabric design pattern distortion deformation determination to adjust the distortion.

REFERENCE SIGNS LIST

100: tenter system, 110: fabric supply unit, 120: introduced-fabric design pattern correction unit, 130: tenter machine, 140: first scanning unit, 150: discharged fabric cooling unit, 160: second scanning unit, 200: standard design pattern, 300: fabric design pattern

What is claimed is:

1. A tenter system having a function of automatically correcting a fabric on the basis of an image, the tenter system comprising:

a tenter machine;

an introduced-fabric design pattern correction unit provided behind the tenter machine and configured to correct an introduced-fabric design pattern of an input fabric introduced into the tenter machine;

a first scanning unit provided in front of the tenter machine and configured to scan a design pattern of a discharged fabric discharged from the tenter machine to acquire a discharged-fabric design pattern image; and a central processing unit configured to communicate with the introduced-fabric design pattern correction unit and the first scanning unit, wherein when a standard design pattern image is input from a user, the discharged-fabric design pattern image is provided by the first scanning unit, the standard design pattern image and the discharged-fabric design pattern image are compared with each other, and a comparison result exceeds a predetermined setting range, the central processing unit controls the introduced-fabric design pattern correction unit to correct the introduced-fabric design pattern by adjusting at least one of a lateral width and supply speed of the introduced fabric.

2. The tenter system of claim 1, further comprising a discharged fabric cooling unit, wherein the discharged fabric cooling unit is disposed between the tenter machine and the first scanning unit.

3. The tenter system of claim 1, wherein the introduced-fabric design pattern correction unit includes a fabric transfer conveyor belt, the fabric transfer conveyor belt includes a first fabric transfer conveyor belt and a second fabric transfer conveyor belt which are disposed to be spaced apart from each other at left and right sides of the introduced fabric and independently controlled, the first fabric transport conveyor belt transports a left edge of the introduced fabric, the second fabric transport conveyor belt transports a right edge of the introduced fabric, and at least one of the first fabric transport conveyor belt and the second fabric transport conveyor belt is configured to be movable laterally to adjust a lateral spacing of the introduced-fabric design pattern.

4. The tenter system of claim 3, wherein at least one of the first fabric transfer conveyor belt and the second fabric transfer conveyor belt is configured to adjust a supply speed of the introduced fabric to adjust a longitudinal spacing of the introduced-fabric design pattern.

5. The tenter system of claim 3, wherein when the central processing unit compares a lateral spacing of the standard design pattern image with a lateral spacing of the discharged-fabric design pattern image and a comparison result exceeds a predetermined setting range, the central processing unit controls the introduced-fabric design pattern correction unit to correct the introduced-fabric design pattern by moving at least one of the first fabric transfer conveyor belt and the second fabric transfer conveyor belt in a lateral direction.

6. The tenter system of claim 4, wherein when the central processing unit compares a longitudinal spacing of the standard design pattern image with a longitudinal spacing of the discharged-fabric design pattern image and a comparison result exceeds a predetermined setting range, the central processing unit controls the introduced-fabric design pattern correction unit to correct the introduced-fabric design pattern by adjusting a rotation speed of at least one of the first fabric transfer conveyor belt and the second fabric transfer conveyor belt.

7. The tenter system of claim 4, wherein when the central processing unit compares the standard design pattern image and the discharged-fabric design pattern image and distortion of the discharged-fabric design pattern image occurs, the central processing unit controls the fabric design pattern correction unit to correct the introduced-fabric design pattern by increasing or decreasing any one of rotation speeds of the first fabric transfer conveyor belt and a rotation speed of the second fabric transfer conveyor belt.

* * * * *